US010328726B2

(12) United States Patent
Kosuge

(10) Patent No.: US 10,328,726 B2
(45) Date of Patent: Jun. 25, 2019

(54) LABEL CREATION APPARATUS AND CONTROL METHOD IN LABEL CREATION APPARATUS

(71) Applicant: Seiko Epson Corporation, Tokyo (JP)

(72) Inventor: Shinsaku Kosuge, Nagano (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/768,200

(22) PCT Filed: Sep. 16, 2016

(86) PCT No.: PCT/JP2016/077554
§ 371 (c)(1),
(2) Date: Apr. 13, 2018

(87) PCT Pub. No.: WO2017/064980
PCT Pub. Date: Apr. 20, 2017

(65) Prior Publication Data

US 2018/0311977 A1 Nov. 1, 2018

(30) Foreign Application Priority Data

Oct. 16, 2015 (JP) ..... 2015-204816

(51) Int. Cl.

| | |
|---|---|
| ***B41J 11/00*** | (2006.01) |
| ***B41J 11/42*** | (2006.01) |
| ***B41J 3/407*** | (2006.01) |
| ***B26D 1/08*** | (2006.01) |
| ***B41J 11/70*** | (2006.01) |

(52) U.S. Cl.
CPC ..... *B41J 11/0095* (2013.01); *B26D 1/08* (2013.01); *B41J 3/4075* (2013.01); *B41J 11/42* (2013.01); *B41J 11/703* (2013.01)

(58) Field of Classification Search
CPC ..... B41J 13/00; B41J 13/0009; B41J 15/00; B41J 15/04; B41J 15/044; B41J 15/046; B41J 3/4075; B41J 11/46; B41J 11/0095; B41J 11/703; B41J 11/42
See application file for complete search history.

(56) References Cited

U.S. PATENT DOCUMENTS

2012/0243049 A1* 9/2012 Takayama ..... B41J 11/0065 358/1.18
2015/0015658 A1* 1/2015 Murata ..... B41J 15/044 347/218
2016/0271978 A1* 9/2016 Sasaki ..... B41J 11/703

FOREIGN PATENT DOCUMENTS

JP S63-106646 U 7/1988
JP 05-162409 A 6/1993
(Continued)

*Primary Examiner* — Kristal Feggins
(74) *Attorney, Agent, or Firm* — Foley & Lardner LLP

(57) ABSTRACT

A label creation apparatus includes a control unit that controls, at a time of continuously creating a plurality of labels by a label creation unit, the label creation unit to resume the creation of the labels from an n-th label when determining a tape-end state in which a tape end of the tape has passed through a printing position based on a detection result of a detection unit in a tape-end detection period for the n-th label, the tape-end detection period for the n-th label indicating a period from a point at which an (n−1)-th label has been determined to be completed to a point at which the n-th label has been determined to be completed.

6 Claims, 11 Drawing Sheets

(56) References Cited

FOREIGN PATENT DOCUMENTS

| | | | |
|---|---|---|---|
| JP | 3290024 | B2 | 6/2002 |
| JP | 2008-001065 | A | 1/2008 |

* cited by examiner

LABEL CREATION APPARATUS AND CONTROL METHOD IN LABEL CREATION APPARATUS

TECHNICAL FIELD

The present invention relates to a label creation apparatus that performs printing on a tape to create a label and a control method in the label creation apparatus.

BACKGROUND ART

Conventionally, there has been known a thermal printer including a thermal head, a platen, a sheet cutter provided on the downstream side of the thermal head, a reflective optical sensor provided at a position facing the tip end of the sheet cutter, and a warning buzzer. At the time of starting printing, the thermal printer reverses the platen to perform back feed by a prescribed amount so that the tip end of a print sheet comes to a printing position. If the print sheet is not detected by the reflective optical sensor before performing the back feed, the thermal printer rings the warning buzzer. In the way described above, the thermal printer prevents idle printing (see Patent Document 1).

[Patent Document 1] JP-U-63-106646

DISCLOSURE OF THE INVENTION

The present inventor has found out the following problems.

When a tape has been put into a "tape-end" state in which the end of the tape has passed through a print head (printing position) in the middle of the operation of creating the n-th label at the time of continuously creating a plurality of labels in a label creation apparatus, the n-th label becomes imperfect. In view of this, it is assumed that the label creation apparatus includes a detection unit to detect the presence or absence of the tape at a detection position on the downstream side of the printing position, and that the creation of the labels is resumed from the n-th label after the replacement of the tape when the absence of the tape is detected at the detection position in the middle of the operation of creating the n-th label. However, even in this way, the absence of the tape is detected at the detection position in the middle of the operation of creating the (n+1)-th label rather than being detected in the middle of the operation of creating the n-th label when the end of the tape has passed through the printing position but has not passed through the detection position at a point at which the operation of creating the n-th label is ended. In this case, the label creating apparatus resumes the creation of the labels from the (n+1)-th label rather than resuming the creation of the labels from n-th label. Therefore, the n-th label is not created again even if the n-th label becomes imperfect due to the tape put into the tape-end state in the middle of the operation of creating the n-th label.

The present invention has an object of providing a label creation apparatus and a control method in the label creation apparatus capable of creating the n-th label again when the n-th label becomes imperfect due to a tape put into a tape-end state in the middle of the operation of creating the n-th label.

The present invention provides a label creation apparatus that performs printing on a tape to create a label, the label creation apparatus including: a label creation unit having a print head and a driving unit, the print head performing printing on the tape at a printing position on a feeding path for the tape, the driving unit driving a platen roller that feeds the tape sandwiched between the print head and the platen roller at the printing position and a feeding unit that feeds the tape on a downstream side of the printing position on the feeding path; a detection unit that detects presence or absence of the tape at a detection position on the downstream side of the printing position on the feeding path; and a control unit that controls, at a time of continuously creating a plurality of the labels by the label creation unit, the label creation unit to resume the creation of the labels from an n-th label when determining a tape-end state in which a tape end of the tape has passed through the printing position based on a detection result of the detection unit in a tape-end detection period for the n-th label, the tape-end detection period for the n-th label indicating a period from a point at which an (n−1)-th label has been determined to be completed to a point at which the n-th label has been determined to be completed, wherein the control unit determines that the n-th label has been completed when the driving unit operates by a prescribed amount after an end of an operation of creating the n-th label by the label creation unit.

The present invention provides a control method in a label creation apparatus that performs printing on a tape to create a label, the label creation apparatus including a label creation unit having a print head and a driving unit, the print head performing printing on the tape at a printing position on a feeding path for the tape, the driving unit driving a platen roller that feeds the tape sandwiched between the print head and the platen roller at the printing position and a feeding unit that feeds the tape on a downstream side of the printing position on the feeding path, and a detection unit that detects presence or absence of the tape at a detection position on the downstream side of the printing position on the feeding path, the control method performing: a step of determining whether the tape has been put into a tape-end state based on a detection result of the detection unit in a tape-end detection period for an n-th label at a time of continuously creating a plurality of the labels by the label creation unit, the tape-end detection period for the n-th label indicating a period from a point at which an (n−1)-th label has been determined to be completed to a point at which the n-th label has been determined to be completed; a step of resuming the creation of the labels from the n-th label when the tape has been determined to be put into the tape-end state in the tape-end detection period for the n-th label; and a step of determining that the n-th label has been completed when the driving unit operates by a prescribed amount after an end of an operation of creating the n-th label by the label creation unit.

According to the configuration, even when the tape has been put into the tape-end state but has not determined to be put into the tape-end state at a point at which the operation of creating the n-th label is ended, it can be determined that the tape has been put into the tape-end state until the driving unit operates by a prescribed amount, i.e., before the n-th label has been determined to be completed. As a result, the creation of the labels is resumed from the n-th label. Thus, according to the configuration, the n-th label can be created again when the n-th label becomes imperfect due to the tape put into the tape-end state in the middle of the operation of creating the n-th label.

In the label creation apparatus, the control unit preferably determines that the tape has been put into the tape-end state when the absence of the tape is detected by the detection unit, and the control unit preferably determines that the n-th label has been completed at a point at which the driving unit operates by at least an amount corresponding to a distance between the printing position and the detection position to feed the tape after an end of a printing operation on the n-th label by the print head.

According to the configuration, when the tape end has not pass through the detection position but has passed through the printing position at a point at which the printing operation on the n-th label by the print head is ended, the tape end passes through the detection position until the driving unit operates by the amount corresponding to the distance between the printing position and the detection position, i.e., before it is determined by the control unit that the n-th label has been completed. Therefore, it is determined by the control unit that the tape has been put into the tape-end state in the tape-end detection period for the n-th label. As a result, the creation of the labels is resumed from the n-th label. Thus, according to the configuration, the n-th label L can be created again when an error that printing on the n-th label becomes imperfect occurs in the n-th label because the tape end has passed through the printing position in the middle of the printing operation on the n-th label.

In this case, the label creation unit preferably further has a half cutter that forms cut lines on a surface layer of the tape at a position on the downstream side of the printing position on the feeding path, the half cutter preferably performs a half-cut operation on the n-th label at the time of continuously creating the plurality of the labels, the half-cut operation on the n-th label indicating an operation of forming the cut lines on the surface layer of the tape at a boundary between the n-th label and an (n+1)-th label, the control unit preferably determines that the tape has been put into the tape-end state when the absence of the tape is detected by the detection unit, and the control unit preferably determines that the n-th label has been completed at a point at which the driving unit operates by at least an amount corresponding to a distance between the printing position and the detection position to feed the tape after an end of the half-cut operation on the n-th label.

According to the configuration, when the tape end has not passed through the detection position but has passed through the printing position at a point at which the half-cut operation on the n-th label by the half cutter is ended, the tape end passes through the detection position until the driving unit operates by the amount corresponding to the distance between the printing position and the detection position to feed the tape, i.e., before it is determined by the control unit that the n-th label has been completed. Therefore, it is determined by the control unit that the tape has been put into the tape-end state in the tape-end detection period for the n-th label. As a result, the creation of the labels is resumed from the n-th label. Thus, according to the configuration, the n-th label L can be created again when an error that the deviation of cutting lines or the like occurs in the n-th label because the tape end has passed through the printing position until the half-cut operation on the n-th label is performed since the end of the printing operation on the n-th label.

In this case, the label creation unit preferably further has a full cutter that cuts off the tape at a full-cut position between the printing position and the detection position on the feeding path, the full cutter preferably performs a full-cut operation on the n-th label at the time of continuously creating the plurality of the labels, the full-cut operation on the n-th label indicating an operation of cutting off the tape at a boundary between the n-th label and an (n+1)-th label, the control unit preferably determines that the tape has been put into the tape-end state when the presence of the tape is not detected by the detection unit at a point at which the driving unit operates by at least an amount corresponding to a distance between the full-cut position and the detection position to feed the tape after an end of the full-cut operation on the n-th label, and the control unit preferably determines that the n-th label has been completed at a point at which the presence of the tape is detected by the detection unit until the driving unit operates by at least the amount corresponding to the distance between the full-cut position and the detection position to feed the tape after the end of the full-cut operation on the n-th label.

According to the configuration, when the tape end has not passed through the detection position but has passed through the printing position at a point at which the full-cut operation on the n-th label by the full cutter is ended, the (n+1)-th label is not fed even if the driving unit operates by the amount corresponding to the distance between the full-cut position and the detection position. Therefore, the presence of the tape is not detected by the detection unit. Thus, it is determined by the control unit that the tape has been put into the tape-end state before it is determined by that control unit that the n-th label has been completed, i.e., in the tape-end detection period for the n-th label. As a result, the creation of the labels is resumed from the n-th label. Thus, according to the configuration, the n-th label L can be created again when an error that the deviation of a cutting part by the full cutter or the like occurs in the n-th label because the tape end has passed through the printing position until the full-cut operation on the n-th label is performed since the end of the printing operation on the n-th label.

In this case, the feeding unit preferably has a pair of rollers that feeds the sandwiched tape, and the detection unit preferably detects the presence or absence of the tape between the pair of rollers.

According to the configuration, the feeding unit and the detection unit are not required to be arranged side by side in a line along the feeding path on which the tape is to be fed. Therefore, the feeding path can be shortened, and space efficiency can be improved.

BEST MODES FOR CARRYING OUT THE INVENTION

Hereinafter a description will be given, with reference to the accompanying drawings, a label creation apparatus 1 according to an embodiment of the present invention.

Figure 1:
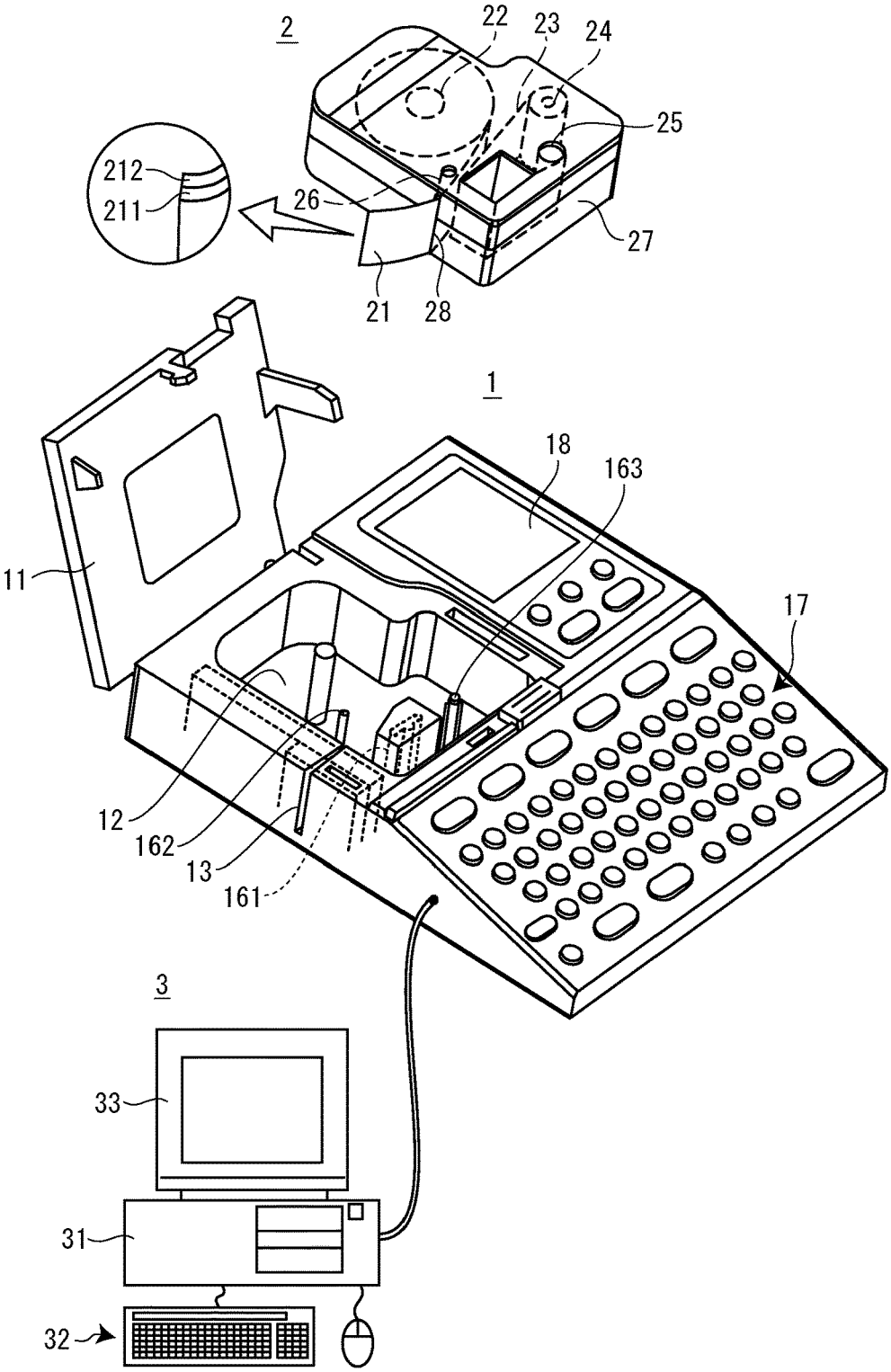
FIG. 1 is a diagram showing a label creation apparatus according an embodiment of the present invention, a tape cartridge to be loaded into the label creation apparatus, and an information processing apparatus connected to the label creation apparatus.

A description will be given, with reference to FIG. 1, of the label creation apparatus 1, a tape cartridge 2 to be loaded into the label creation apparatus 1, and an information processing apparatus 3 communicably connected to the label creation apparatus 1.

The information processing apparatus 3 is, for example, a general-purpose personal computer. The information processing apparatus 3 includes a PC body 31, an operation unit 32, and a display unit 33. The PC body 31 includes a CPU (Central Processing Unit), a ROM (Read Only Memory), a RAM (Random Access Memory), and a hard disk drive. In the PC body 31, application software adapted to the label creation apparatus 1 is installed. The operation unit 32 includes a keyboard and a mouse. The operation unit 32 receives the input/edit operations or the like of character strings that are to be printed by the label creation apparatus 1. The display unit 33 displays character strings, various messages, or the like that are being input/edited. The information processing apparatus 3 transmits various commands and various data to the label creation apparatus 1 based on the input/edit operations or the like of character strings received by the operation unit 32.

The label creation apparatus 1 performs printing on a tape 21 to create a label L (see FIG. 4B) based on various commands and various data transmitted from the information processing apparatus 3. The label creation apparatus 1 includes an opening/closing lid 11, a cartridge loading part 12, and a tape ejection port 13. Although omitted in FIG. 1, the label creation apparatus 1 includes a detection unit 14 and a control unit 15 (see FIG. 2). In addition, the label creation apparatus 1 includes a label creation unit 16 (see FIG. 2), but FIG. 1 shows only some constituents (such as a print head 161).

Note that the label creation apparatus 1 includes an operation panel 17 that functions like the operation unit 32 of the information processing apparatus 3 and a display 18 that functions like the display unit 33 of the information processing apparatus 3. Therefore, the label creation apparatus 1 is capable of creating the label L even in a standalone configuration in which the label creation apparatus 1 is not connected to the information processing apparatus 3.

The opening/closing lid 11 opens/closes the cartridge loading part 12. The tape cartridge 2 is attachably/detachably loaded into the cartridge loading part 12. In the cartridge loading part 12, the print head 161, a platen driving shaft 162, and a winding driving shaft 163 that will be described later are provided.

The tape ejection port 13 is a place at which the printed tape 21 fed from the tape cartridge 2 loaded into the cartridge loading part 12 is to be ejected.

The tape cartridge 2 includes the tape 21, a tape core 22, an ink ribbon 23, a ribbon feeding core 24, a ribbon winding core 25, a platen roller 26, and a cartridge case 27 that accommodates these constituents. The cartridge case 27 is provided with a tape delivering port 28.

The tape 21 includes a print tape 211 and a release tape 212. Printing is performed on one of the front and rear surfaces of the print tape 211. The other of the front and rear surfaces of the print tape 211 is coated with an adhesive, and the release tape 212 is releasably affixed to the print tape 211 via the adhesive. The tape 21 is feedably wound on the tape core 22. The tape 21 fed from the tape core 22 is delivered from the tape delivering port 28 to the outside of the cartridge case 27.

On the ribbon feeding core 24, the ink ribbon 23 is feedably wound. The ink ribbon 23 fed from the ribbon feeding core 24 is wound by the ribbon winding core 25. The ribbon winding core 25 engages the winding driving shaft 163 in a state in which the tape cartridge 2 is loaded into the cartridge loading part 12.

The platen roller 26 engages the platen driving shaft 162 in a state in which the tape cartridge 2 is loaded into the cartridge loading part 12. In this state, the platen roller 26 sandwiches the tape 21 and the ink ribbon 23 between the print head 161 and the platen roller 26.

Figure 2:
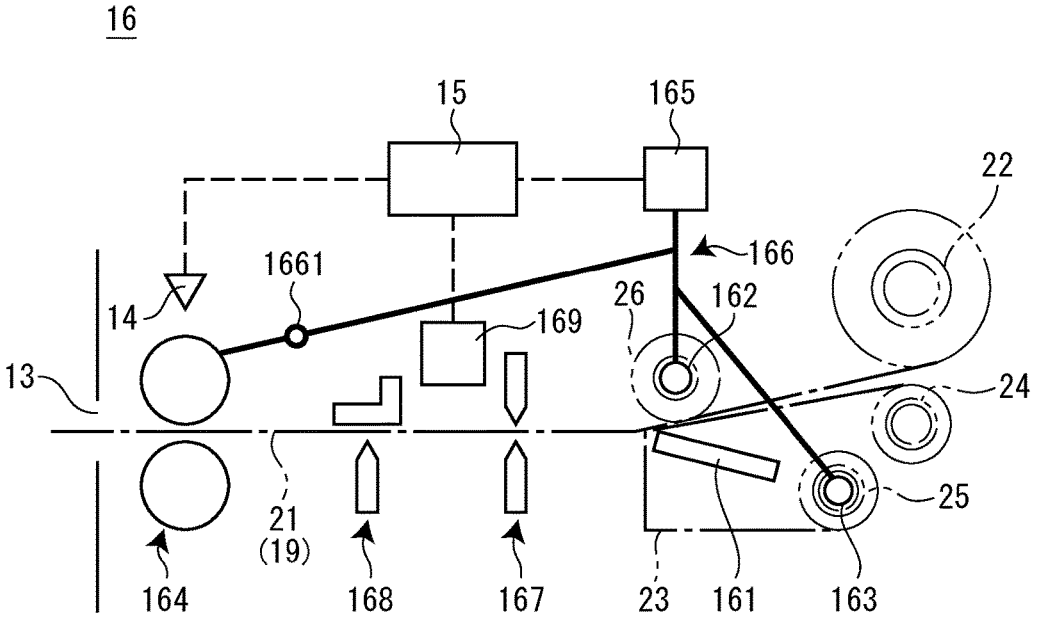
FIG. 2 is a schematic diagram showing a label creation unit of the label creation apparatus shown in FIG. 1.

A description will be given, with reference to FIG. 2, of the label creation unit 16, the detection unit 14, and the control unit 15. The label creation unit 16 includes the print head 161, the platen driving shaft 162, the winding driving shaft 163, a pair of rollers 164, a feeding motor 165, a gear train 166, a full cutter 167, a half cutter 168, and a cutter motor 169.

The print head 161 and the platen driving shaft 162, the full cutter 167, the half cutter 168, and the pair of rollers 164 are provided in this order from an upstream side along a feeding path 19 of the tape 21.

The print head 161 performs printing on the tape 21 sandwiched together with the ink ribbon 23 between the platen roller 26 and the print head 161. That is, the ink of the ink ribbon 23 is transferred onto the tape 21 by heat applied from the print head 161 to the ink ribbon 23 to perform printing on the tape 21.

The platen driving shaft 162 is provided at a position facing the print head 161 across the feeding path 19 through which the tape 21 is to be fed. The platen driving shaft 162 engages the platen roller 26 in a state in which the tape cartridge 2 is loaded into the cartridge loading part 12. The platen driving shaft 162 rotates with the feeding motor 165 as a driving source. When the platen driving shaft 162 rotates, the platen roller 26 engaging the platen driving shaft 162 also rotates. Thus, the tape 21 and the ink ribbon 23 sandwiched between the platen roller 26 and the print head 161 are fed.

The winding driving shaft 163 engages the ribbon winding core 25 in a state in which the tape cartridge 2 is loaded into the cartridge loading part 12. The winding driving shaft 163 rotates with the feeding motor 165 as a driving source. When the winding driving shaft 163 rotates, the ribbon winding core 25 engaging the winding driving shaft 163 also rotates. Thus, the ink ribbon 23 is wound by the ribbon winding core 25.

The pair of rollers 164 rotates with the feeding motor 165 as a driving source. Thus, the pair of rollers 164 ejects the sandwiched tape 21 toward the tape ejection port 13.

Figure 3A:
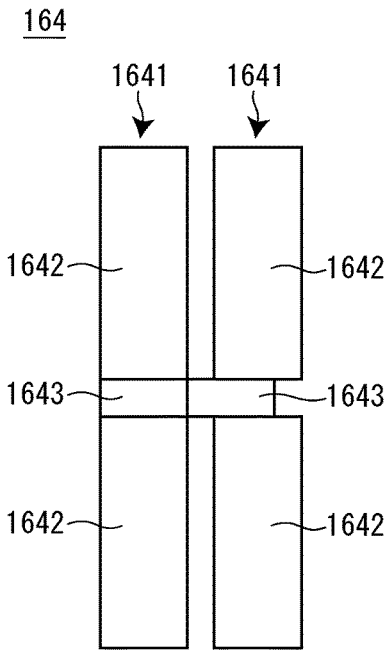
FIG. 3A is a diagram showing a pair of rollers of the label creation unit shown in FIG. 2.
Figure 3B:
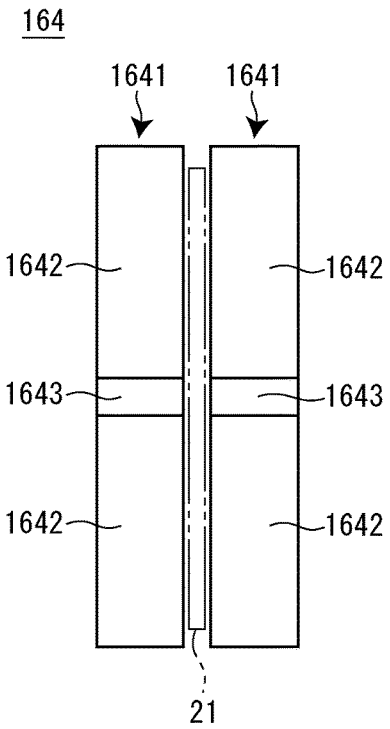
FIG. 3B is a diagram showing the pair of rollers of the label creation unit shown in FIG. 2.

As shown in FIGS. 3A and 3B, each of rollers 1641 constituting the pair of rollers 164 includes a roller body 1642 and a gear-shaped rotation body 1643. The rotation body 1643 is a member for detecting the presence or absence of the tape 21 between the pair of rollers 164 with the detection unit 14. The rotation body 1643 is rotatably provided about an axis common to the roller body 1642. In addition, the rotation body 1643 incorporated in one of the rollers is separably provided with respect to the rotation body 1643 incorporated in the other of the rollers. That is, one of the rotation bodies 1643 engages the other of the rotation bodies 1643 in a state in which the tape 21 is absent between the pair of rollers 164 (see FIG. 3A). One of the rotation bodies 1643 disengages and separates from the other of the rotation bodies 1643 in a state in which the tape 21 is present between the pair of rollers 164 (see FIG. 3B).

Referring back to FIG. 2, a description will be given again. The feeding motor 165 is a driving source for the platen driving shaft 162, the winding driving shaft 163, and the pair of rollers 164. The feeding motor 165 is a stepping motor. The gear train 166 transmits the power of the feeding motor 165 to the platen driving shaft 162, the winding driving shaft 163, and the pair of rollers 164. That is, the gear train 166 branches off from the feeding motor 165 to the platen driving shaft 162, the winding driving shaft 163, and the pair of rollers 164. Thus, the platen driving shaft 162, the winding driving shaft 163, and the pair of rollers 164 rotate in conjunction with each other.

Here, if the peripheral speed of the pair of rollers 164 is slower than that of the platen roller 26, the tape 21 is bent between the platen roller 26 and the pair of rollers 164, which causes a factor responsible for jamming or the like. Therefore, the reduction gear ratio of the gear train 166 is so designed that the peripheral speed of the pair of rollers 164 becomes, for example, 1.2 times as fast as that of the platen roller 26. Further, a clutch mechanism 1661 is incorporated in the middle of the gear train 166 branching off toward the pair of rollers 164. The clutch mechanism 1661 is, for example, a torque limiter. The clutch mechanism 1661 absorbs a difference in the peripheral speed between the pair of rollers 164 and the platen roller 26. That is, when the tape 21 is fed in a state of extending between the platen roller 26 and the pair of rollers 164, the pair of rollers 164 rotates at the same peripheral speed as that of the platen roller 26 in such a manner that the clutch mechanism 1661 slides. On the other hand, when the tape 21 is fed only by the pair of rollers 164, the clutch mechanism 1661 does not slide and the pair of rollers 164 rotates at a peripheral speed faster than that of the platen roller 26. Accordingly, the tape 21 is fed faster when fed only by the pair of rollers 164, compared with a case in which the tape 21 is fed in a state of extending between the platen roller 26 and the pair of rollers 164.

The full cutter 167 performs a full-cut operation with the cutter motor 169 as a driving source. Thus, the full cutter 167 cuts off the tape 21. That is, the full cutter 167 cuts off both the print tape 211 and the release tape 212. The half cutter 168 performs a half-cut operation with the cutter motor 169 as a driving source. Thus, the half cutter 168 cuts off only the print tape 211 without cutting off the release tape 212 to form cut lines on the surface layer (the surface on the side of the print tape 211) of the tape 21. Note that the half cutter 168 may be configured to cut off the release tape 212 without cutting off the print tape 211 to form cut lines on the surface layer (the surface on the side of the release tape 212) of the tape 21. In the following description, the cut lines formed on the surface layer of the tape 21 will be called half-cut lines H (see FIG. 4D). The cutter motor 169 is a driving source for the full cutter 167 and the half cutter 168.

Note that a position at which printing is to be performed on the tape 21 by the print head 161, i.e., a position at which the tape 21 and the ink ribbon 23 are to be sandwiched by the print head 161 and the platen roller 26 on the feeding path 19 will be called a printing position P1. A position at which the tape 21 is to be cut off by the full cutter 167 on the feeding path 19 will be called a full-cut position P2. A position at which the half-cut lines H are to be formed on the tape 21 by the half cutter 168 on the feeding path 19 will be called a half-cut position P3. A position at which the presence or absence of the tape 21 is to be detected by the detection unit 14, i.e., a position at which the tape 21 is to be sandwiched by the pair of rollers 164 on the feeding path 19 will be called a detection position P4. As a positional relationship between positions from the printing position P1 to the detection position P4, the printing position P1, the full-cut position P2, the half-cut position P3, and the detection position P4 are set in this order from the upstream side of the feeding path 19.

The detection unit 14 detects the presence or absence of the tape 21 between the pair of rollers 164, i.e., at the detection position P4. That is, the detection unit 14 detects whether the rotation body 1643 incorporated in one of the rollers 1641 is separated from the rotation body 1643 incorporated in the other of the rollers 1641 to detect the presence or absence of the tape 21 between the pair of rollers 164.

The control unit 15 transmits and receives various commands and various data to and from the information processing apparatus 3 and controls each of the units of the label creation apparatus 1 based on the received various commands and the various data. The control unit 15 includes a CPU, a ROM, and a RAM. The CPU runs various programs stored in the ROM using the RAM to perform various processing.

A description will be given, with reference to FIGS. 4A to 4G, of continuous printing to be performed by the label creation apparatus 1. The continuous printing is processing for continuously creating a plurality of labels L. Note that the character strings of the plurality of labels L continuously printed may be, for example, the same strings such as "ABC," "ABC," and "ABC" or strings having sequential numbers such as "No. 1," "No. 2," and "No. 3."

Figure 4A:
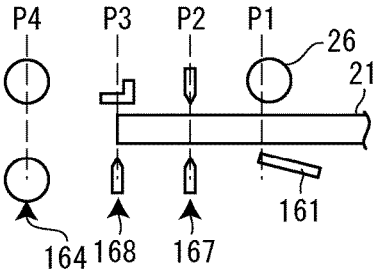
FIG. 4A is a diagram for describing continuous printing performed by the label creation apparatus shown in FIG. 1.

FIG. 4A shows a state in which the tape 21 has been cut off by the full cutter 167 in the previous printing processing and the tip end of the tape 21 has been set at the full-cut position P2. Upon receiving print data based on a character string input/edited through the information processing apparatus 3, the number of the labels L to be continuously printed, and a command for performing printing, the label creation apparatus 1 starts the continuous printing.

Figure 4B:
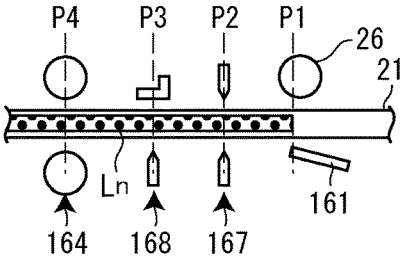
FIG. 4B is a diagram showing a step after FIG. 4A.

In the continuous printing, the label creation apparatus 1 performs the printing on the tape 21 with the print head 161 while feeding the tape 21 with the platen roller 26. FIG. 4B shows a state in which a printing operation on the n-th label L has been completed. Note that in FIG. 4B or the like, the printed part of the (n−1)-th label L is indicated by a slanted pattern, the printed part of the n-th label L is indicated by a dot pattern, and the printed part of the (n+1)-th label L is indicated by solid black for illustration convenience. In addition, in FIG. 4B or the like, a suffix n added to a symbol L indicates that a label L is the n-th one.

A description will be given of processing after the completion of the printing operation on the n-th label L for each of the cases of continuous printing without cutting, half-cut continuous printing, and full-cut continuous printing.

Figure 4C:
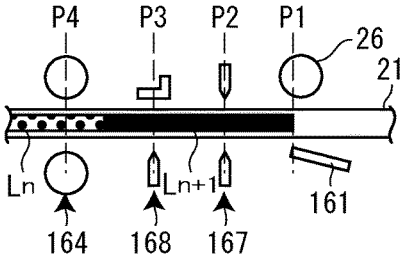
FIG. 4C is a diagram showing a step after FIG. 4B in the case of continuous printing without cutting.

In the continuous printing without cutting, as shown in FIG. 4C, the label creation apparatus 1 does not cut off the tape 21 at the boundary between the n-th label L and the (n+1)-th label L and does not form the half-cut lines H on the tape 21 at the boundary between the n-th label L and the (n+1)-th label L. That is, the label creation apparatus 1 continues to perform the printing on the (n+1)-th label L without stopping the feeding of the tape 21 even if the boundary between the n-th label L and the (n+1)-th label L reaches the full-cut position P2 or the half-cut position P3.

Figure 4D:
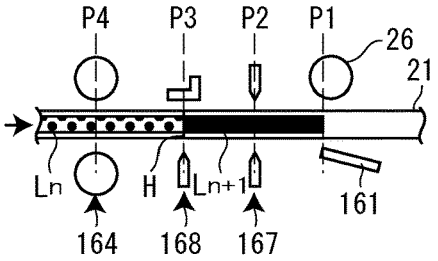
FIG. 4D is a diagram showing a step after FIG. 4B in the case of half-cut continuous printing.
Figure 4E:
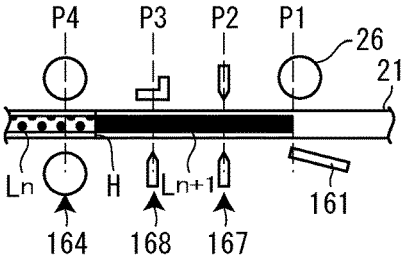
FIG. 4E is a diagram showing a step after FIG. 4D.

In the half-cut continuous printing, as shown in FIG. 4D, the label creation apparatus 1 stops the printing on the (n+1)-th label L and forms the half-cut lines H on the tape 21 at the boundary between the n-th label L and the (n+1)-th label L with the half cutter 168 when the boundary between the n-th label L and the (n+1)-th label L reaches the half-cut position P3. After that, as shown in FIG. 4E, the label creation apparatus 1 resumes the printing on the (n+1)-th label L.

Figure 4F:
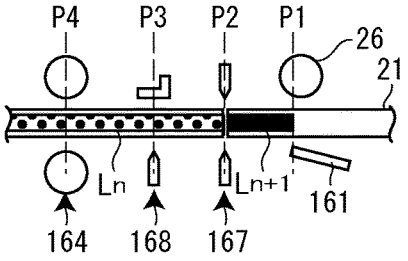
FIG. 4F is a diagram showing a step after FIG. 4B in the case of full-cut continuous printing.
Figure 4G:
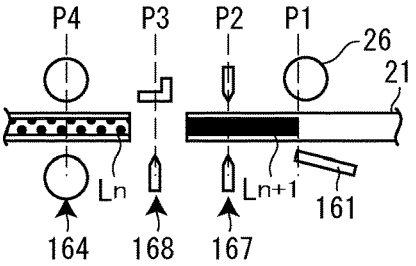
FIG. 4G is a diagram showing a step after FIG. 4F.

In the full-cut continuous printing, as shown in FIG. 4F, the label creation apparatus 1 stops the printing on the (n+1)-th label L and cuts off the tape 21 at the boundary between the n-th label L and the (n+1)-th label L with the full cutter 167 when the boundary between the n-th label L and the (n+1)-th label L reaches the full-cut position P2. After that, as shown in FIG. 4G, the label creation apparatus 1 ejects the n-th label L from the tape ejection port 13 with the pair of rollers 164 and resumes the printing on the (n+1)-th label L. Note that since the peripheral speed of the pair of rollers 164 is faster than that of the platen roller 26 as described above, the n-th label L is fed faster than the tape 21 in which the printing is being performed on the (n+1)-th label L.

Figure 5A:
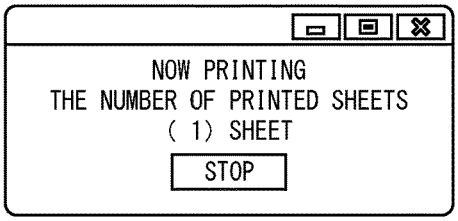
FIG. 5A is a diagram showing contents displayed by the information processing apparatus during continuous printing.
Figure 5B:
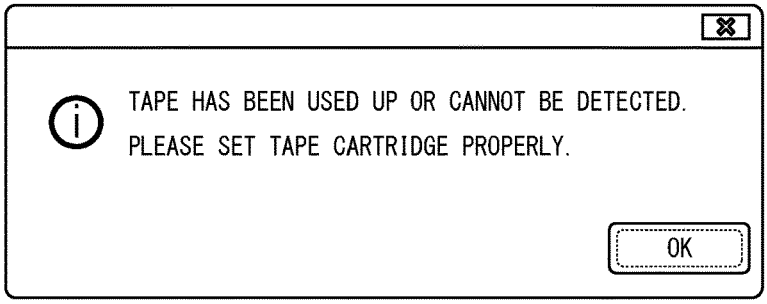
FIG. 5B is a diagram showing contents displayed by the information processing apparatus during the continuous printing.
Figure 5C:
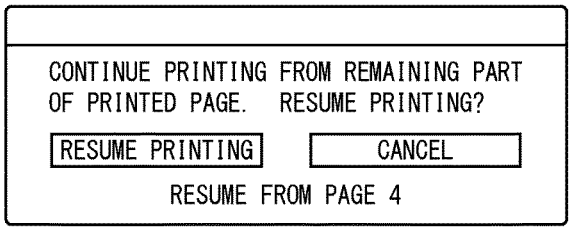
FIG. 5C is a diagram showing contents displayed by the information processing apparatus during the continuous printing.

A description will be given, with reference to FIGS. 5A to 5C, of contents to be displayed on the display unit 33 by the information processing apparatus 3 during the continuous printing. As shown in FIG. 5A, the information processing apparatus 3 displays information as to what number of the labels L is being printed (created) on the display unit 33 during the continuous printing. As will be described later, upon receiving the fact that the tape 21 has been put into a tape-end state and a detected number from the label creation apparatus 1, the information processing apparatus 3 displays a message urging the replacement of the tape cartridge 2 on the display unit 33 as shown in FIG. 5B. When the indication of an "OK" is pressed by clicking or the like on the display shown in FIG. 5B after the replacement of the tape cartridge 2, the information processing apparatus 3 displays a message inquiring about the resumption (creation) of the printing on the label L as shown in FIG. 5C. At this time, the information processing apparatus 3 also displays information as to what number of the labels L is to be printed again on the display unit 33. When the indication of "resume printing" is pressed by clicking or the like on the display shown in FIG. 5C, the information processing apparatus 3 transmits a command for resuming the printing on the label L to the control unit 15. Note that the label creation apparatus 1 may display on the display 18 these messages or the like displayed on the display unit 33 by the information processing apparatus 3.

Subsequently, a description will be given of tape-end detection control to be performed by the control unit 15 during the continuous printing. In the tape-end detection control during the continuous printing, the control unit 15 determines whether a tape end E of the tape 21 has passed through the printing position P1, i.e., whether the tape 21 has been put into a tape-end state, based on a detection result of the detection unit 14.

Here, during the continuous printing without cutting and the half-cut continuous printing, it is determined that the tape end E has passed through the printing position P1 when the absence of the tape 21 is detected by the detection unit 14 after the detection of the tip end of the tape 21 by the detection unit 14. Accordingly, the control unit 15 determines that the tape 21 has been put into the tape-end state when the absence of the tape 21 is detected by the detection unit 14 after the detection of the tip end of the tape 21 by the detection unit 14.

In the full-cut continuous printing, the control unit 15 determines that the tape 21 has been put into the tape-end state when the absence of the tape 21 is detected by the detection unit 14 like the continuous printing without cutting and the half-cut continuous printing until a full-cut operation is performed after the detection of the tip end of the tape 21 by the detection unit 14. In addition, when the presence of the tape 21 is not detected by the detection unit 14 even if the feeding motor 165 operates by a second operation amount that will be described later after the full-cut operation is performed, it is assumed that the tape end E has passed through the printing position P1 at a point at which the full-cut operation is performed. This is because the tape 21 on the upstream side of the full-cut position P2 cannot be fed any more even if the feeding motor 165 operates when the tape end E has passed through the printing position P1 at a point at which the full-cut operation is performed. Accordingly, the control unit 15 determines that the tape 21 has been put into the tape-end state when the presence of the tape 21 is not detected by the detection unit 14 at a point at which the feeding motor 165 operates by the second operation amount after the full-cut operation is performed.

Note that when the presence of the tape 21 is not detected by the detection unit 14 even if the feeding motor 165 operates by the second operation amount after the full-cut operation is performed, the tape end E has not passed through the printing position P1 at a point at which the full-cut operation is performed. However, it can also be assumed that the remaining length of the tape 21 has become shorter than the distance between the platen roller 26 (printing position P1) and the pair of rollers 164 (detection position P4). This is because the tape 21 is fed only until the tape end E passes through the printing position P1 even if the feeding motor 165 operates by the second operation amount after the full-cut operation is performed and thus the tape 21 does not reach the detection position P4.

Here, the second operation amount refers to the operation amount (step number) of the feeding motor 165 required to feed the tape 21 by an amount corresponding to the distance between the full-cut position P2 and the detection position P4, preferably an amount corresponding to a distance obtained by adding a slight distance to the distance between the full-cut position P2 and the detection position P4 in consideration of the feeding accuracy of the tape 21. That is, the second operation amount corresponds to the operation amount of the feeding motor 165 required when the tip end of the (n+1)-th label L reaches the detection position P4 after the full-cut operation on the n-th label L is performed. Note that the full-cut operation on the n-th label L refers to a full-cut operation for cutting off the tape 21 at the boundary between the n-th label L and the (n+1)-th label L.

The control unit 15 controls the label creation unit 16 to stop the creation of the labels L when determining that the tape 21 has been put into the tape-end state. In addition, the control unit 15 transmits the fact that the tape 21 has been put into the tape-end state and a detected number to the information processing apparatus 3 when determining that the tape 21 has been put into the tape-end state. Note that the detected number is information indicating which one of the tape end detection periods for the labels L is regarded as a period in which the tape 21 has been determined to be put into the tape-end state.

Here, the control unit 15 starts a tape-end detection period for the n-th label L when determining that the (n−1)-th label L has been completed, and ends the tape-end detection period for the n-th label L when determining that the n-th label L has been completed. In the respective comparative examples of the tape-end detection control that will be described later, the control unit 15 determines that the n-th label L has been completed at a point at which the operation of creating the n-th label L by the label creation unit 16 is ended. In addition, in the respective embodiments of the tape-end detection control that will be described later, the control unit 15 determines that the n-th label L has been completed when the feeding motor 165 operates by a prescribed amount after the end of the operation of creating the n-th label L by the label creation unit 16. Hereinafter, a timing at which the control unit 15 determines that the n-th label L has been completed will be described in the order of a comparative example and an embodiment for each of the cases of the continuous printing without cutting, the half-cut continuous printing, and the full-cut continuous printing.

First, a description will be given of a comparative example and an embodiment of the tape-end detection control during the continuous printing without cutting. In the comparative example of the tape-end detection control during the continuous printing without cutting, the control unit 15 determines that the n-th label L has been completed at a point at which the printing operation on the n-th label is ended. Therefore, the control unit 15 starts a tape-end detection period for the n-th label L at a point at which the printing operation on the (n−1)-th label L is ended, and ends the tape-end detection period for the n-th label L at the point at which the printing operation on the n-th label L is ended.

A description will be specifically given, with reference to FIGS. 6A to 6D, of the comparative example of the tape-end detection control during the continuous printing without cutting.

Figure 6A:
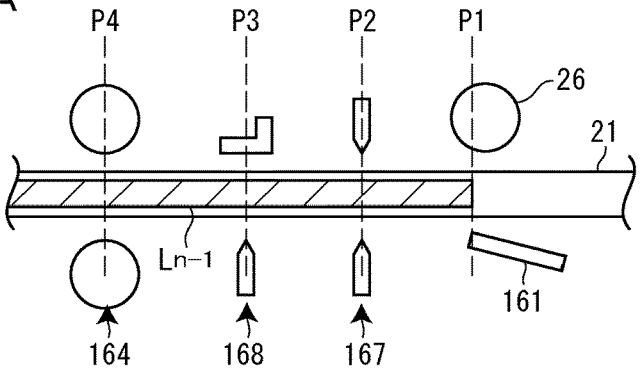
FIG. 6A is a diagram for describing a comparative example of tape-end detection control during the continuous printing without cutting.

FIG. 6A shows a state in which the printing operation on the (n−1)-th label L has been ended. At this point, the control unit 15 determines that the (n−1)-th label L has been completed.

Figure 6B:
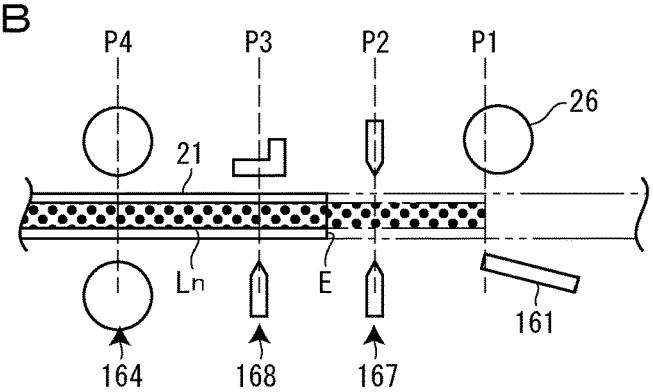
FIG. 6B is a diagram showing a step after FIG. 6A.

FIG. 6B shows a state in which the printing operation on the n-th label L has been ended after the passage of the tape end E through the printing position P1 in the middle of the printing operation on the n-th label L. At this point, the control unit 15 determines that the n-th label L has been completed. At this time, the tape end E has passed through the printing position P1 but has not passed through the detection position P4. In addition, since the tape end E has passed through the printing position P1 in the middle of the printing operation on the n-th label L, an error that printing on the n-th label L becomes imperfect occurs in the n-th label L.

Figure 6C:
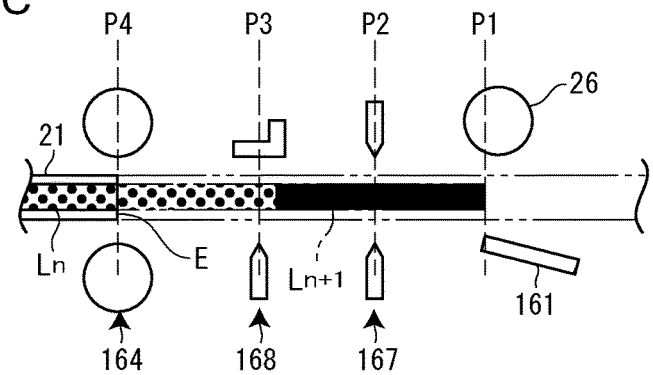
FIG. 6C is a diagram showing a step after FIG. 6B.

FIG. 6C shows a state in which the tape end E has passed through the detection position P4 after the end of the printing operation on the n-th label L. At this time, since the absence of the tape 21 is detected by the detection unit 14, the control unit 15 determines that the tape 21 has been put into the tape-end state.

Figure 6D:
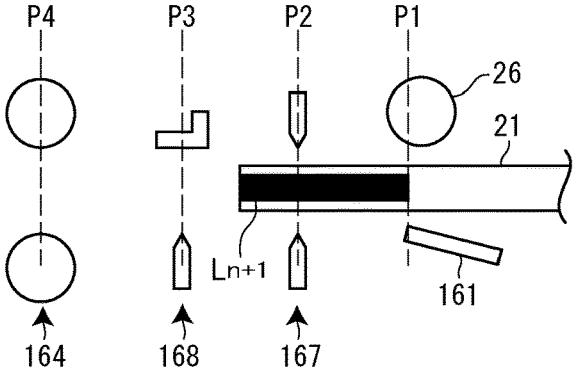
FIG. 6D is a diagram showing a step after FIG. 6C.

FIG. 6D shows a state in which the creation of the labels L has been resumed from the (n+1)-th label L. As described above, the control unit 15 determines that the tape 21 has been put into the tape-end state after determining the completion of the n-th label L, i.e., in the tape-end detection period for the (n+1)-th label L. As a result, the control unit 15 controls the label creation unit 16 to resume the creation of the labels L from the (n+1)-th label L when resuming the creation of the labels L.

As described above, in the comparative example of the tape-end detection control during the continuous printing without cutting, it is determined that the tape 21 has been put into the tape-end state in the tape-end detection period for the (n+1)-th label L when the tape end E has passed through the printing position P1 but has not passed through the detection position P4 at the point at which the printing operation on the n-th label L is ended. As a result, the creation of the labels L is resumed from the (n+1)-th label L. Accordingly, in the comparative example, the n-th label L may not be created again when an error that printing on the n-th label L becomes imperfect occurs in the n-th label L because the tape end E has passed through the printing position P1 in the middle of the printing operation on the n-th label L.

On the other hand, in the embodiment of the tape-end detection control during the continuous printing without cutting, the control unit 15 determines that the n-th label L has been completed at a point at which the feeding motor 165 operates by a first operation amount after the end of the printing operation on the n-th label L. Therefore, the control unit 15 starts the tape-end detection period for the n-th label L at the point at which the feeding motor 165 operates by the first operation amount after the end of the printing operation on the (n−1)-th label L, and ends the tape-end detection period for the n-th label L at a point at which the feeding motor 165 operates by the first operation amount after the end of the printing operation on the n-th label L. Note that the first operation amount refers to the operation amount (step number) of the feeding motor 165 required to feed the tape 21 by an amount corresponding to the distance between the printing position P1 and the detection position P4, preferably an amount corresponding to a distance obtained by adding a slight distance to the distance between the printing position P1 and the detection position P4 in consideration of the feeding accuracy of the tape 21. That is, the first operation amount corresponds to a substantial operation amount of the feeding motor 165 required by the tape end E to reach the detection position P4 when the tape end E has passed through the printing position P1 but has not reached the detection position P4 at a point at which the printing operation is ended.

A description will be specifically given, with reference to FIGS. 7A to 7D, of the embodiment of the tape-end detection control during the continuous printing without cutting.

Figure 7A:
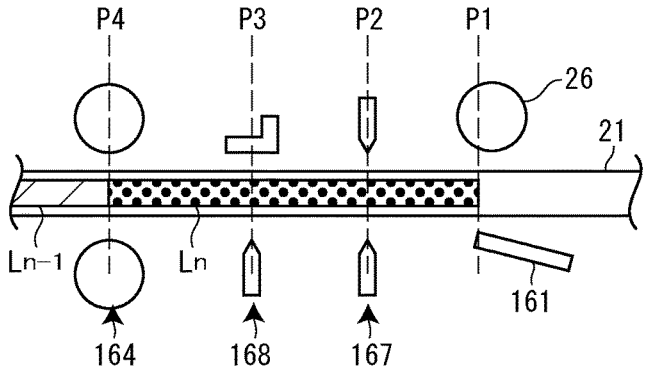
FIG. 7A is a diagram for describing an embodiment of the tape-end detection control during the continuous printing without cutting.

FIG. 7A shows a state in which the feeding motor 165 has operated by the first operation amount after the end of the printing operation on the (n−1)-th label L. At this point, the control unit 15 determines that the (n−1)-th label L has been completed.

Figure 7B:
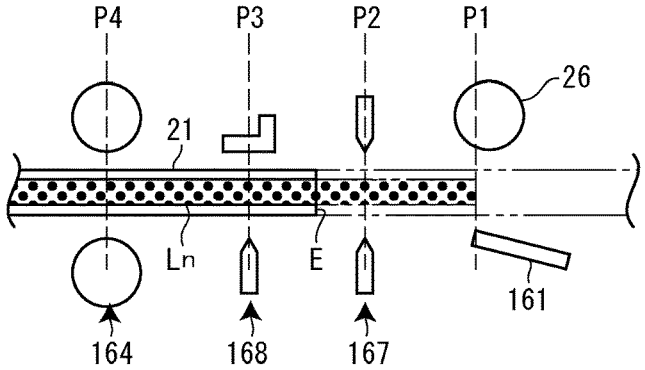
FIG. 7B is a diagram showing a step after FIG. 7A.

FIG. 7B shows a state in which the printing operation on the n-th label L has been ended after the passage of the tape end E through the printing position P1 in the middle of the printing operation on the n-th label L. At this time, the tape end E has passed through the printing position P1 but has not passed through the detection position P4. In addition, since the tape end E has passed through the printing position P1 in the middle of the printing operation on the n-th label L, an error that printing on the n-th label L becomes imperfect occurs in the n-th label L.

Figure 7C:
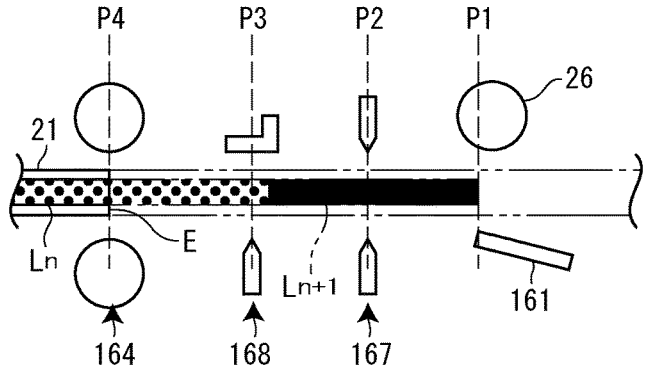
FIG. 7C is a diagram showing a step after FIG. 7B.

FIG. 7C shows a state in which the tape end E has passed through the detection position P4 before the feeding motor 165 operates by the first operation amount after the end of the printing operation on the n-th label L. At this time, since the absence of the tape 21 is detected by the detection unit 14, the control unit 15 determines that the tape 21 has been put into the tape-end state. At this point, the feeding motor 165 has not operated by the first operation amount, and thus the control unit 15 does not determine that the n-th label L has been completed.

Figure 7D:
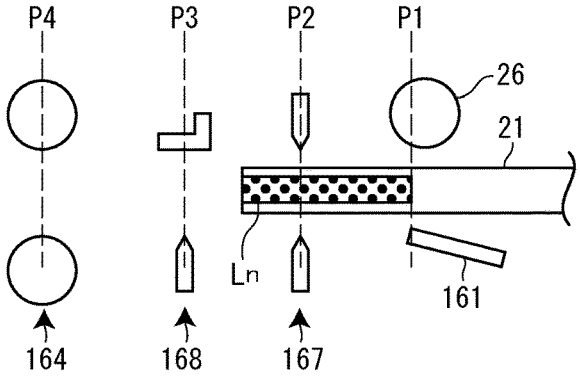
FIG. 7D is a diagram showing a step after FIG. 7C.

FIG. 7D shows a state in which the creation of the labels L has been resumed from the n-th label L. As described above, the control unit 15 determines that the tape 21 has been put into the tape-end state before determining the completion of the n-th label L, i.e., in the tape-end detection period for the n-th label L. As a result, the control unit 15 controls the label creation unit 16 to resume the creation of the labels L from the n-th label L when resuming the creation of the labels L.

As described above, in the embodiment of the tape-end detection control during the continuous printing without cutting, it is determined that the tape 21 has been put into the tape-end state in the tape-end detection period for the n-th label L when the tape end E has passed through the printing position P1 but has not passed through the detection position P4 at the point at which the printing operation on the n-th label L is ended. As a result, the creation of the labels L is resumed from the n-th label L. Accordingly, in the embodiment, the n-th label L may not be created again when an error that printing on the n-th label L becomes imperfect occurs in the n-th label L because the tape end E has passed through the printing position P1 in the middle of the printing operation on the n-th label L.

In other words, in the embodiment, the detection unit 14 that detects the presence or absence of the tape 21 between the pair of rollers 164, i.e., at the detection position P4 may detect whether the tape end E has passed through the printing position P1 at the point at which the printing operation on the n-th label L is ended.

Next, a description will be given of a comparative example and an embodiment of the tape-end detection control during the half-cut continuous printing. In the comparative example of the tape-end detection control during the half-cut continuous printing, the control unit 15 determines that the n-th label L has been completed at a point at which the half-cut operation on the n-th label is performed. Therefore, the control unit 15 starts a tape-end detection period for the n-th label L at a point at which the half-cut operation on the (n−1)-th label L is performed, and ends the tape-end detection period for the n-th label L at the point at which the half-cut operation on the n-th label L is performed. Note that the half-cut operation on the n-th label L refers to a half-cut operation for forming the half-cut lines H on the tape 21 at the boundary between the n-th label L and the (n+1)-th label L.

A description will be specifically given, with reference to FIGS. 8A to 8D, of the comparative example of the tape-end detection control during the half-cut continuous printing.

Figure 8A:
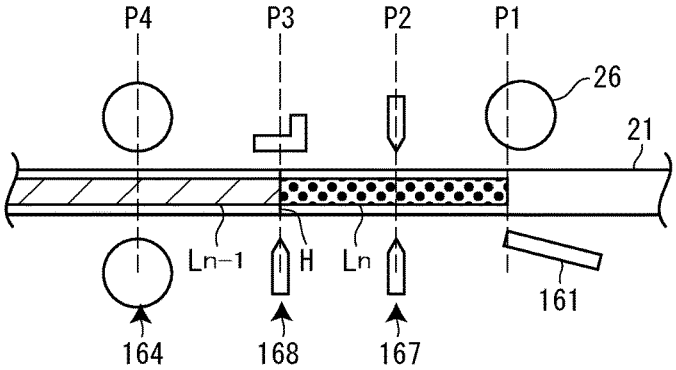
FIG. 8A is a diagram for describing a comparative example of the tape-end detection control during the half-cut continuous printing.

FIG. 8A shows a state in which the half-cut operation on the (n−1)-th label L has been performed. At this point, the control unit 15 determines that the (n−1)-th label L has been completed.

Figure 8B:
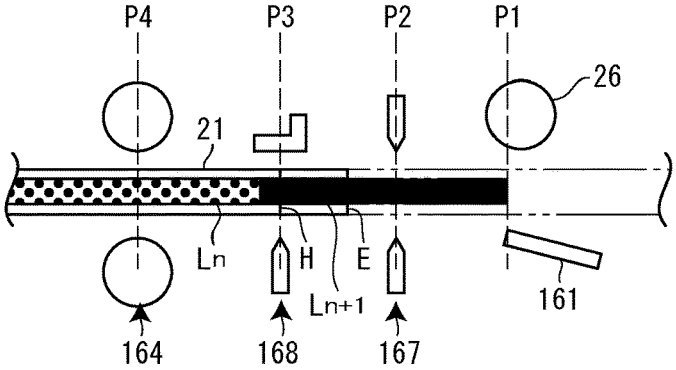
FIG. 8B is a diagram showing a step after FIG. 8A.

FIG. 8B shows a state in which the half-cut operation on the n-th label L has been performed after the passage of the tape end E through the printing position P1 until the half-cut operation on the n-th label L is performed since the end of the printing operation on the n-th label L. At this point, the control unit 15 determines that the n-th label L has been completed. At this time, the tape end E has passed through the printing position P1 but has not passed through the detection position P4. In addition, the tape end E has not passed through the printing position P1 at a point at which the printing operation on the n-th label L is ended, and thus the n-th label L is printed to the end. On the other hand, the tape 21 is fed only by the pair of rollers 164 after the tape end E has passed through the printing position P1. Therefore, as described above, the tape 21 is fed faster compared with a case in which the tape 21 is fed in a state of extending between the platen roller 26 and the pair of rollers 164. As a result, an error that the half-cut lines H are formed at a position deviated to the side of the (n+1)-th label L from the boundary between the n-th label L and the (n+1)-th label L occurs in the n-th label L. That is, a part (tip end part) of the (n+1)-th label L is included in the n-th label L.

Figure 8C:
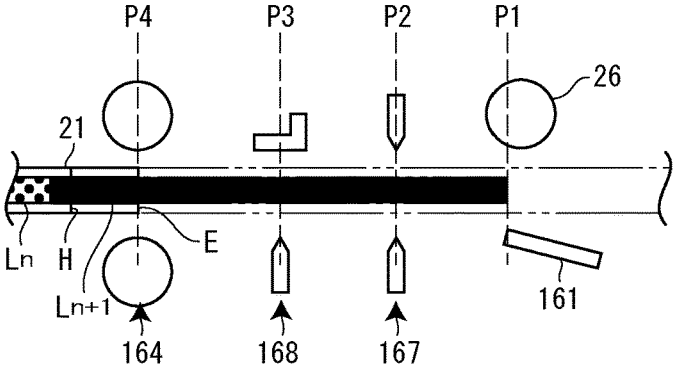
FIG. 8C is a diagram showing a step after FIG. 8B.

FIG. 8C shows a state in which the tape end E has passed through the detection position P4 after the half-cut operation on the n-th label L is performed. At this time, since the absence of the tape 21 is detected by the detection unit 14, the control unit 15 determines that the tape 21 has been put into the tape-end state.

Figure 8D:
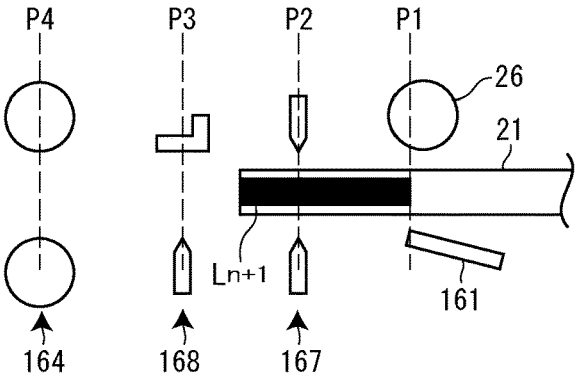
FIG. 8D is a diagram showing a step after FIG. 8C.

FIG. 8D shows a state in which the creation of the labels L has been resumed from the (n+1)-th label L. As described above, the control unit 15 determines that the tape 21 has been put into the tape-end state after determining the completion of the n-th label L, i.e., in a tape-end detection period for the (n+1)-th label L. As a result, the control unit 15 controls the label creation unit 16 to resume the creation of the labels L from the (n+1)-th label L when resuming the creation of the labels L.

As described above, in the comparative example of the tape-end detection control during the half-cut continuous printing, it is determined that the tape 21 has been put into the tape-end state in the tape-end detection period for the (n+1)-th label L when the tape end E has passed through the printing position P1 but has not passed through the detection position P4 at the point at which the half-cut operation on the n-th label L is performed. As a result, the creation of the labels L is resumed from the (n+1)-th label L. Accordingly, in the comparative example, the n-th label L may not be created again when an error that the half-cut lines H are deviated occurs in the n-th label L because the tape end E has passed through the printing position P1 until the half-cut operation on the n-th label L is performed since the end of the printing operation on the n-th label L. In addition, in the comparative example, the n-th label L may not be created again like the comparative example of the tape-end detection control during the continuous printing without cutting when an error that printing on the n-th label L becomes imperfect occurs in the n-th label L because the tape end E has passed through the printing position P1 in the middle of the printing operation on the n-th label L.

On the other hand, in the embodiment of the tape-end detection control during the half-cut continuous printing, the control unit 15 determines that the n-th label L has been completed at a point at which the feeding motor 165 operates by the first operation amount after the half-cut operation on the n-th label L is performed. Therefore, the control unit 15 starts a tape-end detection period for the n-th label L at the point at which the feeding motor 165 operates by the first operation amount after the half-cut operation on the (n−1)-th label L is performed, and ends the tape-end detection period for the n-th label L at a point at which the feeding motor 165 operates by the first operation amount after the half-cut operation on the n-th label L is performed. Here, the first operation amount corresponds to a substantial operation amount of the feeding motor 165 required by the tape end E to reach the detection position P4 when the tape end E has passed through the printing position P1 but has not reached the detection position P4 at a point at which the half-cut operation is performed.

A description will be specifically given, with reference to FIGS. 9A to 9D, of the embodiment of the tape-end detection control during the half-cut continuous printing.

Figure 9A:
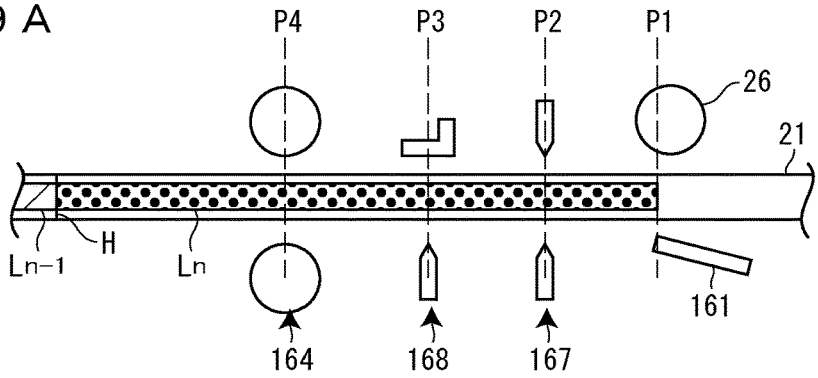
FIG. 9A is a diagram for describing an embodiment of the tape-end detection control during the half-cut continuous printing.

FIG. 9A shows a state in which the feeding motor 165 has operated by the first operation amount after the end of the half-cut operation on the (n−1)-th label L. At this point, the control unit 15 determines that the (n−1)-th label L has been completed.

Figure 9B:
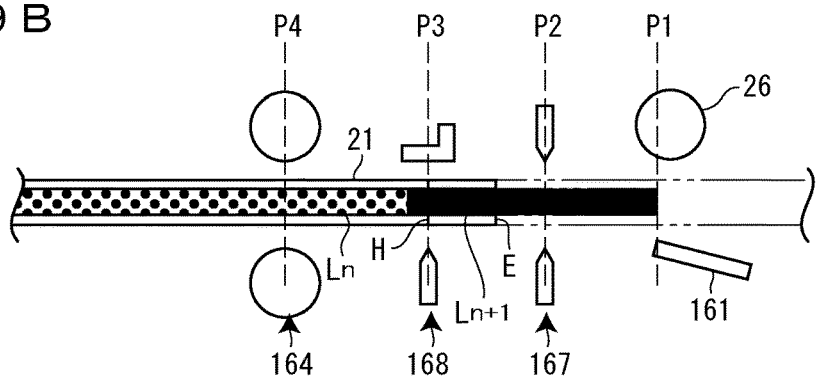
FIG. 9B is a diagram showing a step after FIG. 9A.

FIG. 9B shows a state in which the half-cut operation on the n-th label L has been performed after the passage of the tape end E through the printing position P1 until the half-cut operation on the n-th label L is performed since the end of the printing operation on the n-th label L. At this time, the tape end E has passed through the printing position P1 but has not passed through the detection position P4. In addition, the tape end E has not passed through the printing position P1 at a point at which the printing operation on the n-th label L is ended, and thus the n-th label L is printed to the end. On the other hand, the tape 21 is fed only by the pair of rollers 164 after the tape end E has passed through the printing position P1. As a result, an error that the half-cut lines H are formed at a position deviated to the side of the (n+1)-th label L from the boundary between the n-th label L and the (n+1)-th label L occurs in the n-th label L.

Figure 9C:
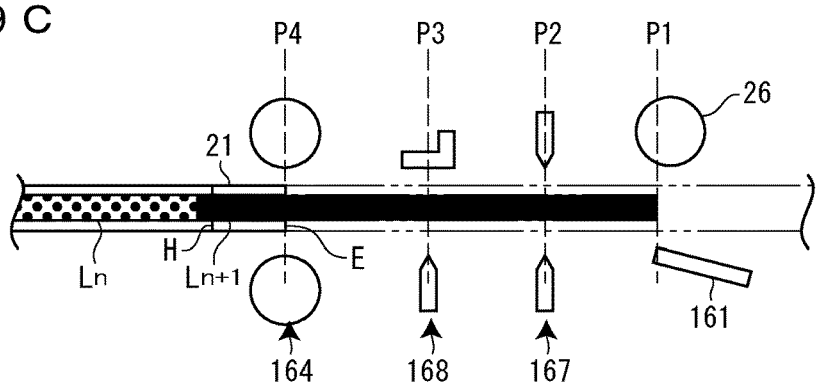
FIG. 9C is a diagram showing a step after FIG. 9B.

FIG. 9C shows a state in which the tape end E has passed through the detection position P4 before the feeding motor 165 operates by the first operation amount after the end of the half-cut operation on the n-th label L. At this time, since the absence of the tape 21 is detected by the detection unit 14, the control unit 15 determines that the tape 21 has been put into the tape-end state. At this point, the feeding motor 165 has not operated by the first operation amount, and thus the control unit 15 does not determine that the n-th label L has been completed.

Figure 9D:
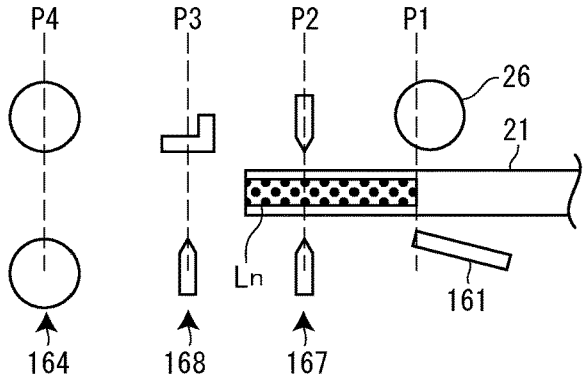
FIG. 9D is a diagram showing a step after FIG. 9C.

FIG. 9D shows a state in which the creation of the labels L has been resumed from the n-th label L. As described above, the control unit 15 determines that the tape 21 has been put into the tape-end state before determining the completion of the n-th label L, i.e., in the tape-end detection period for the n-th label L. As a result, the control unit 15 controls the label creation unit 16 to resume the creation of the labels L from the n-th label L when resuming the creation of the labels L.

As described above, in the embodiment of the tape-end detection control during the half-cut continuous printing, it is determined that the tape 21 has been put into the tape-end state in the tape-end detection period for the n-th label L when the tape end E has passed through the printing position P1 but has not passed through the detection position P4 at the point at which the half-cut operation on the n-th label L is performed. As a result, the creation of the labels L is resumed from the n-th label L. Accordingly, in the embodiment, the n-th label L may be created again when an error that the half-cut lines H are deviated occurs in the n-th label L because the tape end E has passed through the printing position P1 until the half-cut operation on the n-th label L is performed since the end of the printing operation on the n-th label L. In addition, in the embodiment, the n-th label L may be created again like the embodiment of the tape-end detection control during the continuous printing without cutting when an error that printing on the n-th label L becomes imperfect occurs in the n-th label L because the tape end E has passed through the printing position P1 in the middle of the printing operation on the n-th label L.

In other words, in the embodiment, the detection unit 14 that detects the presence or absence of the tape 21 between the pair of rollers 164, i.e., at the detection position P4 may detect whether the passage of the tape end E has passed through the printing position P1 at the point at which the half-cut operation on the n-th label L is ended.

Next, a description will be given of a comparative example and an embodiment of the tape-end detection control during the full-cut continuous printing. In the comparative example of the tape-end detection control during the full-cut continuous printing, the control unit 15 determines that the n-th label L has been completed at a point at which the full-cut operation on the n-th label is performed. Therefore, the control unit 15 starts a tape-end detection period for the n-th label L at a point at which the full-cut operation on the (n−1)-th label L is performed, and ends the tape-end detection period for the n-th label L at the point at which the full-cut operation on the n-th label L is performed. Note that the full-cut operation on the n-th label L refers to a full-cut operation for cutting off the tape 21 at the boundary between the n-th label L and the (n+1)-th label L.

A description will be specifically given, with reference to FIGS. 10A to 10D, of the comparative example of the tape-end detection control during the full-cut continuous printing.

Figure 10A:
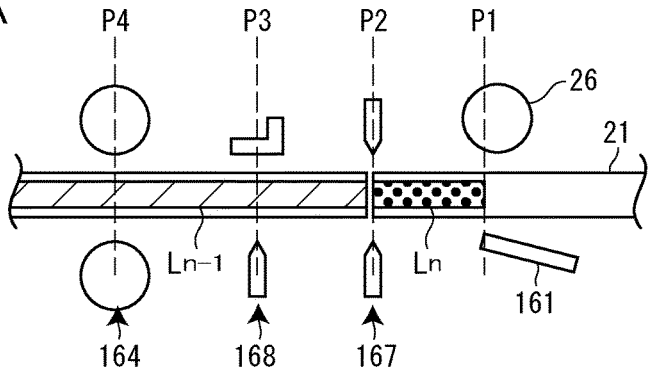
FIG. 10A is a diagram for describing a comparative example of the tape-end detection control during the full-cut continuous printing.

FIG. 10A shows a state in which the full-cut operation on the (n−1)-th label L has been performed. At this point, the control unit 15 determines that the (n−1)-th label L has been completed.

Figure 10B:
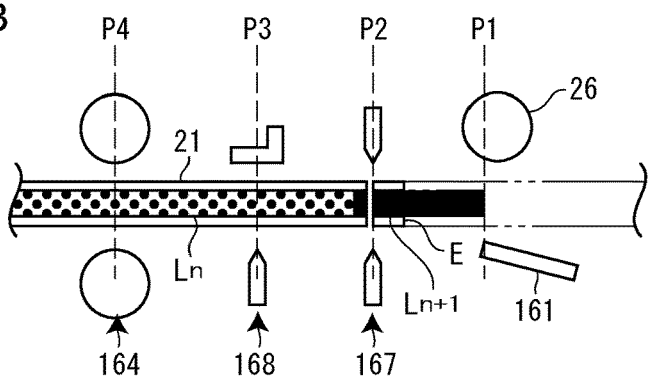
FIG. 10B is a diagram showing a step after FIG. 10A.

FIG. 10B shows a state in which the full-cut operation on the n-th label L has been performed after the passage of the tape end E through the printing position P1 until the full-cut operation on the n-th label L is performed since the end of the printing operation on the n-th label L. At this point, the control unit 15 determines that the n-th label L has been completed. At this time, the tape end E has passed through the printing position P1 but has not passed through the detection position P4. In addition, the tape end E has not passed through the printing position P1 at a point at which the printing operation on the n-th label L is ended, and thus the n-th label L is printed to the end. On the other hand, the tape 21 is fed only by the pair of rollers 164 after the tape end E has passed through the printing position P1. Therefore, as described above, the tape 21 is fed faster compared with a case in which the tape 21 is fed in a state of extending between the platen roller 26 and the pair of rollers 164. As a result, an error that the tape 21 is cut off at a position deviated to the side of the (n+1)-th label L from the boundary between the n-th label L and the (n+1)-th label L occurs in the n-th label L. That is, a part (tip end part) of the (n+1)-th label L is included in the n-th label L.

Figure 10C:
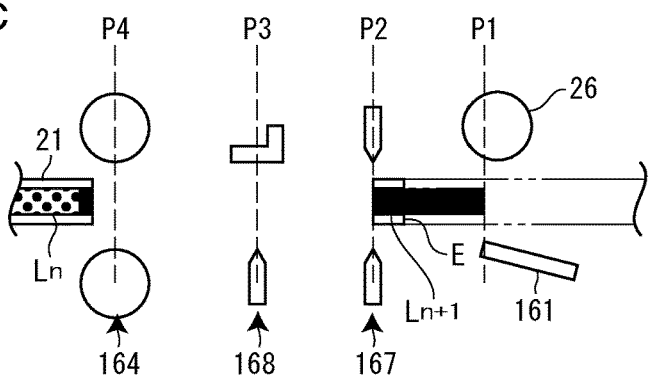
FIG. 10C is a diagram showing a step after FIG. 10B.

FIG. 10C shows a state in which the feeding motor 165 has operated by the second operation amount after the full-cut operation on the n-th label L is performed. At this time, the tape end E has passed through the printing position P1, and thus the (n+1)-th label L is not fed any more. Therefore, since the presence of the tape 21 is not detected by the detection unit 14, the control unit 15 determines that the tape 21 has been put into the tape-end state.

Figure 10D:
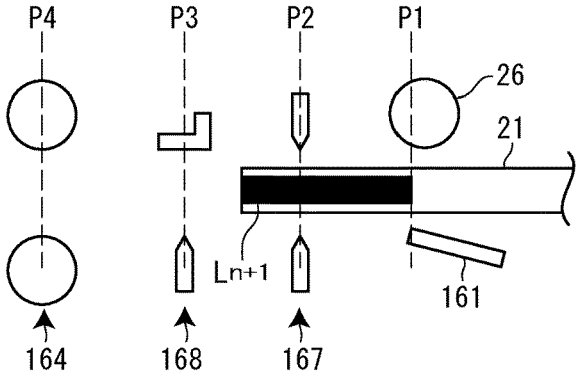
FIG. 10D is a diagram showing a step after FIG. 10C.

FIG. 10D shows a state in which the creation of the labels L has been resumed from the (n+1)-th label L. As described above, the control unit 15 determines that the tape 21 has been put into the tape-end state after determining the completion of the n-th label L, i.e., in a tape-end detection period for the (n+1)-th label L. As a result, the control unit 15 controls the label creation unit 16 to resume the creation of the labels L from the (n+1)-th label L when resuming the creation of the labels L.

As described above, in the comparative example of the tape-end detection control during the full-cut continuous printing, it is determined that the tape 21 has been put into the tape-end state in the tape-end detection period for the (n+1)-th label L when the tape end E has passed through the printing position P1 but has not passed through the detection position P4 at the point at which the full-cut operation on the n-th label L is performed. As a result, the creation of the labels L is resumed from the (n+1)-th label L. Accordingly, in the comparative example, the n-th label L may not be created again when an error that a cutting part is deviated occurs in the n-th label L because the tape end E has passed through the printing position P1 until the full-cut operation on the n-th label L is performed since the end of the printing operation on the n-th label L. In addition, in the comparative example, the n-th label L may not be created again like the comparative example of the tape-end detection control during the continuous printing without cutting when an error that printing on the n-th label L becomes imperfect occurs in the n-th label L because the tape end E has passed through the printing position P1 in the middle of the printing operation on the n-th label L.

On the other hand, in the embodiment of the tape-end detection control during the full-cut continuous printing, the control unit 15 determines that the n-th label L has been completed at a point at which the presence of the tape 21 between the pair of rollers 164 is detected by the detection unit 14 until the feeding motor 165 operates by the second operation amount after the full-cut operation on the n-th label L is performed. Therefore, the control unit 15 starts a tape-end detection period for the n-th label L at the point at which the presence of the tape 21 between the pair of rollers 164 is detected by the detection unit 14 until the feeding motor 165 operates by the second operation amount after the full-cut operation on the (n−1)-th label L is performed. In addition, the control unit 15 ends the tape-end detection period for the n-th label L at a point at which the presence of the tape 21 between the pair of rollers 164 is detected by the detection unit 14 until the feeding motor 165 operates by the second operation amount after the full-cut operation on the n-th label L is performed.

A description will be specifically given, with reference to FIGS. 11A to 11D, of the embodiment of the tape-end detection control during the full-cut continuous printing.

Figure 11A:
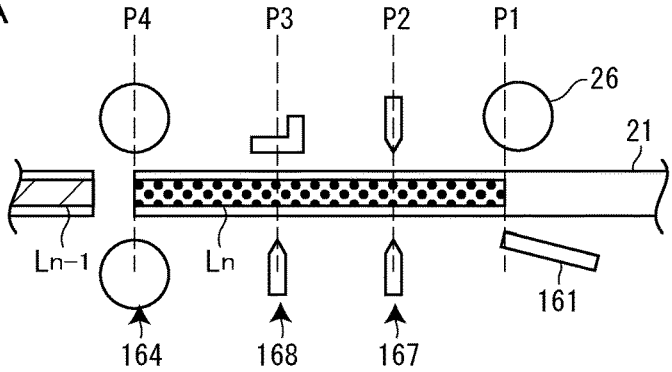
FIG. 11A is a diagram for describing an embodiment of the tape-end detection control during the full-cut continuous printing.

FIG. 11A shows a state in which the feeding motor 165 has operated by the second operation amount after the full-cut operation on the (n−1)-th label L is performed. At this point, the presence of the tape 21 between the pair of rollers 164 is detected by the detection unit 14. Therefore, the control unit 15 determines that the (n−1)-th label L has been completed.

Figure 11B:
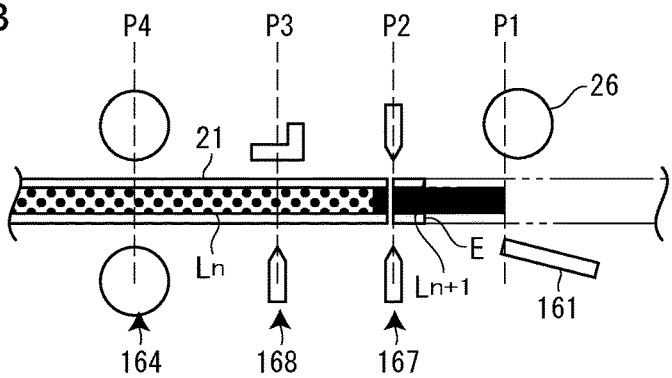
FIG. 11B is a diagram showing a step after FIG. 11A.

FIG. 11B shows a state in which the full-cut operation on the n-th label L has been performed after the passage of the tape end E through the printing position P1 until the full-cut operation on the n-th label L is performed since the end of the printing operation on the n-th label L. At this time, the tape end E has passed through the printing position P1 but has not passed through the detection position P4. In addition, the tape end E has not passed through the printing position P1 at a point at which the printing operation on the n-th label L is ended, and thus the n-th label L is printed to the end. On the other hand, the tape 21 is fed only by the pair of rollers 164 after the tape end E has passed through the printing position P1. As a result, an error that the tape 21 is cut off at a position deviated to the side of the (n+1)-th label L from the boundary between the n-th label L and the (n+1)-th label L occurs in the n-th label L.

Figure 11C:
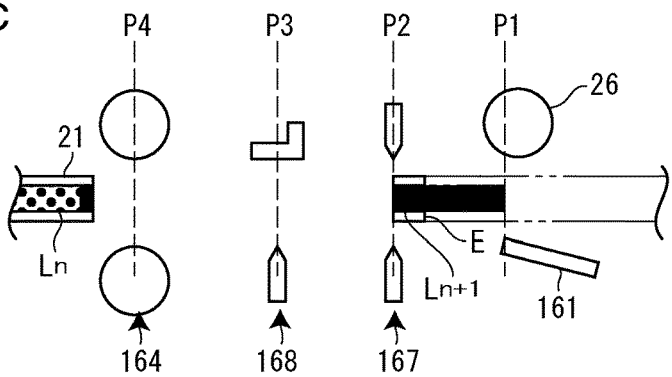
FIG. 11C is a diagram showing a step after FIG. 11B.

FIG. 11C shows a state in which the feeding motor 165 has operated by the second operation amount after the full-cut operation on the n-th label L is performed. At this time, the tape end E has passed through the printing position P1, and thus the (n+1)-th label L is not fed any more. Therefore, since the presence of the tape 21 is not detected by the detection unit 14, the control unit 15 determines that the tape 21 has been put into the tape-end state. At this point, the presence of the tape 21 is not detected by the detection unit 14, and thus the control unit 15 does not determine that the n-th label L has been completed.

Figure 11D:
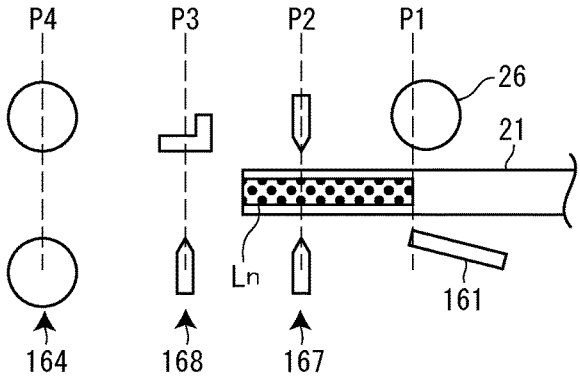
FIG. 11D is a diagram showing a step after FIG. 11C.

FIG. 11D shows a state in which the creation of the labels L has been resumed from the n-th label L. As described above, the control unit 15 determines that the tape 21 has been put into the tape-end state before determining the completion of the n-th label L, i.e., in the tape-end detection period for the n-th label L. As a result, the control unit 15 controls the label creation unit 16 to resume the creation of the labels L from the n-th label L when resuming the creation of the labels L.

As described above, in the embodiment of the tape-end detection control during the full-cut continuous printing, it is determined that the tape 21 has been put into the tape-end state in the tape-end detection period for the n-th label L when the tape end E has passed through the printing position P1 but has not passed through the detection position P4 at the point at which the full-cut operation on the n-th label L is performed. As a result, the creation of the labels L is resumed from the n-th label L. Accordingly, in the embodiment, the n-th label L may be created again when an error that a cutting part by the full cutter 167 is deviated occurs in the n-th label L because the tape end E has passed through the printing position P1 until the full-cut operation on the n-th label L is performed since the end of the printing operation on the n-th label L. In addition, in the embodiment, the n-th label L may be created again like the embodiment of the tape-end detection control during the continuous printing without cutting when an error that printing on the n-th label L becomes imperfect occurs in the n-th label L because the tape end E has passed through the printing position P1 in the middle of the printing operation on the n-th label L.

In other words, in the embodiment, the detection unit 14 that detects the presence or absence of the tape 21 between the pair of rollers 164, i.e., at the detection position P4 may detect whether the tape end E has passed through the printing position P1 at the point at which the full-cut operation on the n-th label L is ended.

As described above, the label creation apparatus 1 according to the embodiment includes the label creation unit 16, the detection unit 14, and the control unit 15. The label creation unit 16 includes the print head 161 and the feeding motor 165. The print head 161 performs printing on the tape 21 at the printing position P1. The feeding motor 165 drives the platen roller 26 and the pair of rollers 164. The detection unit 14 detects the presence or absence of the tape 21 at the detection position P4. The control unit 15 controls, during the continuous printing, the label creation unit 16 to resume the creation of the labels L from the n-th label L when determining that the tape 21 has been put into the tape-end state based on a detection result of the detection unit 14 in the tape-end detection period for the n-th label L. In addition, the control unit 15 determines that the n-th label L has been completed when the feeding motor 165 operates by a prescribed amount after the end of the operation of creating the n-th label L.

According to the configuration, even when it is not determined by the control unit 15 that the tape 21 has been put into the tape-end state although the tape has been put into the tape-end state at a point at which the operation of creating the n-th label L is ended, it can be determined by the control unit 15 that the tape 21 has been put into the tape-end state until the feeding motor 165 operates by a prescribed amount, i.e., before it is determined by the control unit 15 that the n-th label has been completed. As a result, the creation of the labels L is started from the n-th label L. Thus, according to the embodiment, the n-th label L can be created again when the n-th label L becomes imperfect due to the tape 21 put into the tape-end state in the middle of the operation of creating the n-th label L.

Of course, the present invention is not limited to the above embodiment but is capable of employing various configurations without departing from its spirit. For example, the embodiment can be modified into the following modes.

The detection unit 14 may detect the presence or absence of the tape 21 between the pair of rollers 164 by detecting the presence or absence of the energization between the pair of rollers 164. Moreover, the detection unit 14 may detect the presence or absence of the tape 21 by a photointerrupter provided on the downstream side of the printing position P1. Note that the photointerrupter may be provided on the upstream side or the downstream side of the pair of rollers 164 in this case but is preferably provided at the same place as or on the upstream side of the pair of rollers 164 so that the tape end E reliably passes through the detection position P4.

In addition, the label creation apparatus 1 includes the feeding motor 165 common to the platen roller 26 and the pair of rollers 164 as a driving unit that drives the platen roller 26 and the pair of rollers 164, but may include two separate motors, i.e., a motor that drives the platen roller 26 and a motor that drives the pair of rollers 164. Of course, any driving source other than motors is available.

CROSS REFERENCE TO RELATED APPLICATIONS

This application is a National Stage Entry of International Application No. PCT/JP2016/077554, filed on Sep. 16, 2016; which claims priority to Japanese Patent Application No. 2015-204816 filed on Oct. 16, 2015; the entire contents of both of which are incorporated by reference herein.

The invention claimed is:

1. A label creation apparatus that performs printing on a tape to create a label, the label creation apparatus comprising:

a label creation unit having a print head and a driving unit, the print head performing printing on the tape at a printing position on a feeding path for the tape, the driving unit driving a platen roller that feeds the tape sandwiched between the print head and the platen roller at the printing position and a feeding unit that feeds the tape on a downstream side of the printing position on the feeding path;

a detection unit that detects presence or absence of the tape at a detection position on the downstream side of the printing position on the feeding path; and a control unit that controls, at a time of continuously creating a plurality of the labels by the label creation unit, the label creation unit to resume the creation of the labels from an n-th label when determining a tape-end state in which a tape end of the tape has passed through the printing position based on a detection result of the detection unit in a tape-end detection period for the n-th label, the tape-end detection period for the n-th label indicating a period from a point at which an (n−1)-th label has been determined to be completed to a point at which the n-th label has been determined to be completed, wherein the control unit determines that the n-th label has been completed when the driving unit operates by a prescribed amount after an end of an operation of creating the n-th label by the label creation unit.

2. The label creation apparatus according to claim 1, wherein the control unit determines that the tape has been put into the tape-end state when the absence of the tape is detected by the detection unit, and the control unit determines that the n-th label has been completed at a point at which the driving unit operates by at least an amount corresponding to a distance between the printing position and the detection position to feed the tape after an end of a printing operation on the n-th label by the print head.

3. The label creation apparatus according to claim 1, wherein the label creation unit further has a half cutter that forms cut lines on a surface layer of the tape at a position on the downstream side of the printing position on the feeding path, the half cutter performs a half-cut operation on the n-th label at the time of continuously creating the plurality of the labels, the half-cut operation on the n-th label indicating an operation of forming the cut lines on the surface layer of the tape at a boundary between the n-th label and an (n+1)-th label, the control unit determines that the tape has been put into the tape-end state when the absence of the tape is detected by the detection unit, and the control unit determines that the n-th label has been completed at a point at which the driving unit operates by at least an amount corresponding to a distance between the printing position and the detection position to feed the tape after an end of the half-cut operation on the n-th label.

4. The label creation apparatus according to claim 1, wherein the label creation unit further has a full cutter that cuts off the tape at a full-cut position between the printing position and the detection position on the feeding path, the full cutter performs a full-cut operation on the n-th label at the time of continuously creating the plurality of the labels, the full-cut operation on the n-th label indicating an operation of cutting off the tape at a boundary between the n-th label and an (n+1)-th label, the control unit determines that the tape has been put into the tape-end state when the presence of the tape is not detected by the detection unit at a point at which the driving unit operates by at least an amount corresponding to a distance between the full-cut position and the detection position to feed the tape after an end of the full-cut operation on the n-th label, and the control unit determines that the n-th label has been completed at a point at which the presence of the tape is detected by the detection unit until the driving unit operates by at least the amount corresponding to the distance between the full-cut position and the detection position to feed the tape after the end of the full-cut operation on the n-th label.

5. The label creation apparatus according to claim 1, wherein the feeding unit has a pair of rollers that feeds the sandwiched tape, and the detection unit detects the presence or absence of the tape between the pair of rollers.

6. A control method in a label creation apparatus that performs printing on a tape to create a label, the label creation apparatus including a label creation unit having a print head and a driving unit, the print head performing printing on the tape at a printing position on a feeding path for the tape, the driving unit driving a platen roller that feeds the tape sandwiched between the print head and the platen roller at the printing position and a feeding unit that feeds the tape on a downstream side of the printing position on the feeding path, and a detection unit that detects presence or absence of the tape at a detection position on the downstream side of the printing position on the feeding path, the control method performing:

a step of determining whether the tape has been put into a tape-end state based on a detection result of the detection unit in a tape-end detection period for an n-th label at a time of continuously creating a plurality of the labels by the label creation unit, the tape-end detection period for the n-th label indicating a period from a point at which an (n−1)-th label has been determined to be completed to a point at which the n-th label has been determined to be completed;

a step of resuming the creation of the labels from the n-th label when the tape has been determined to be put into the tape-end state in the tape-end detection period for the n-th label; and a step of determining that the n-th label has been completed when the driving unit operates by a prescribed amount after an end of an operation of creating the n-th label by the label creation unit.

* * * * *